US008551561B2

(12) United States Patent
Duluard et al.

(10) Patent No.: US 8,551,561 B2
(45) Date of Patent: Oct. 8, 2013

(54) NON-ELECTROLYTIC DEPOSITION METHOD

(75) Inventors: Sandrine Duluard, Charenton le Pont (FR); Claudine Biver, Charenton-le-Pont (FR)

(73) Assignee: Essilor International (compagnie Generale d'optiqu), Charenton le Pont (FR)

( * ) Notice: Subject to any disclaimer, the term of this patent is extended or adjusted under 35 U.S.C. 154(b) by 317 days.

(21) Appl. No.: 12/995,290

(22) PCT Filed: Jun. 23, 2009

(86) PCT No.: PCT/FR2009/051194

§ 371 (c)(1), (2), (4) Date: Nov. 30, 2010

(87) PCT Pub. No.: WO2009/156692

PCT Pub. Date: Dec. 30, 2009

(65) Prior Publication Data

US 2011/0070361 A1 Mar. 24, 2011

(30) Foreign Application Priority Data

Jun. 27, 2008 (FR) ..... 08 54341

(51) Int. Cl.
*B05D 5/12* (2006.01)
*G02F 1/153* (2006.01)

(52) U.S. Cl.
USPC ..... 427/108; 359/275

(58) Field of Classification Search
USPC ..... 427/108; 359/275
See application file for complete search history.

(56) References Cited

U.S. PATENT DOCUMENTS

| | | | |
|---|---|---|---|
| 4,590,117 | A | 5/1986 | Taniguchi et al. |
| 2006/0035105 | A1 | 2/2006 | Wessling |
| 2009/0081370 | A1 | 3/2009 | Lowinski et al. |

FOREIGN PATENT DOCUMENTS

| | | |
|---|---|---|
| EP | 1 614 771 | 1/2006 |
| EP | 1 630 252 | 3/2006 |

*Primary Examiner* — James Lin
(74) *Attorney, Agent, or Firm* — Occhiuti Rohlicek & Tsao LLP

(57) ABSTRACT

The invention relates to a method for the non-electrolytic deposition of a compound, preferably an electrochromic compound, comprising the following successive steps: (a) an electroconductive layer is deposited on a non-conductive solid substrate; (b) a reducing agent or an oxidizing agent (=redox agent) is deposited on an area of said electroconductive layer, said area covering only a portion of the surface of said electroconductive layer; and (c) a solution of a precursor of the compound to be deposited is brought into contact both with the redox agent and with at least a portion of the area of said electroconductive layer not covered by the redox agent, said precursor being chosen from those having an oxidation-reduction potential higher or lower than the redox agent and forming, after an oxidation-reduction reaction, a compound insoluble in the solution of the precursor of the compound to be deposited.

14 Claims, No Drawings

NON-ELECTROLYTIC DEPOSITION METHOD

CROSS-REFERENCE TO RELATED APPLICATIONS

This application is the National Stage of International Application No. PCT/FR2009/051194, filed on Jun. 23, 2009, which claims the priority of French Patent Application No. 08 54341, filed on Jun. 27, 2008. The contents of both applications are hereby incorporated by reference in their entirety.

The present invention relates to a novel process for the non-electrolytic deposition of compounds, in particular electrochromic compounds, onto a non-conductive solid substrate.

Electrochromic devices typically have a structure comprising at least five layers, namely two transparent outer layers, for example two organic or mineral glass plates, two electrically conductive layers formed, for example, from a film of tin-doped indium oxide (indium-tin oxide, ITO) deposited on the inner face of each of the outer layers, and an electrolyte placed between the two electrically conductive layers. The electrochromic compound may be either introduced into the electrolyte or deposited on one or the other or both of the electrically conductive layers.

The deposition of a thin layer of at least one electrochromic compound onto a substrate covered with an electrically conductive layer is performed, for example, by electroplating, i.e. by connecting the electrically conductive layer to an electrode and then immersing the object to be coated in a bath containing a precursor of the electrochromic compound to be deposited. Application of a potential difference between the electrode connected to the conductive layer and a counterelectrode in contact with the bath containing the precursor of the electrochromic compound brings about a redox reaction (reduction or oxidation) of the precursor of the electrochromic compound on the surface of the conductive layer and deposition of the electrochromic compound formed at said surface.

The apparatus for performing such an electroplating process is relatively complex and requires adaptation of the geometry of the various components of the electroplating device to the size of the item to be coated. A problem arises in particular for items of large size on which it is difficult to obtain uniform depositions. The relatively high square resistance of ITO films, of at least 60 ohms/square on a plastic substrate, is specifically reflected by a reduction in the thickness of the electrochromic deposit when the distance relative to the point of connection of the electrode increases.

The aim of the present invention was to propose a process for the deposition of electrochromic compounds onto supports coated with electrically conductive layers (often referred to hereinbelow as conductive layers), which would make it possible simultaneously to overcome the problems of adaptation of the dimensions of the electroplating device to the size of the object to be coated and to facilitate the production of deposits of uniform thickness over extended areas. The process developed by the Applicant makes it possible to solve, with simple and inexpensive means, both of these problems. The operating principle of the process of the present invention consists essentially in replacing the two electrodes of the electroplating device with a sufficient amount of a redox agent placed on a limited area of the conductive layer. When the conductive layer, in contact with the redox agent, is then placed in contact with a solution of a suitable precursor of an electrochromic compound to be deposited, an indirect redox reaction takes place, via the conductive layer, between the redox agent deposited thereon and the precursor in the solution. The precursor in solution, by coming into contact with the surface of the conductive layer, is reduced or oxidized and forms an insoluble compound that becomes deposited on the surface of the conductive layer. During this redox reaction involving the redox agent (reducing or oxidizing agent) and the precursor in the solution, the exchange of electrons takes place indirectly via the electrically conductive layer.

Although this principle was developed by the Applicant for the purpose of preparing electrochromic devices, i.e. devices using transparent substrates, transparent conductive layers and electrochromic compounds, it is, however, also applicable to nonconductive substrates and opaque electrically conductive layers and to non-electrochromic compounds. The application of the non-electrolytic deposition process described hereinbelow to the manufacture of electrochromic devices consequently constitutes merely a preferred embodiment of the process of the present invention.

One subject of the present invention is consequently a process for the non-electrolytic deposition of a compound, comprising the following successive steps:

(a) deposition of an electrically conductive layer onto a nonconductive solid substrate, (b) deposition of a reducing agent or an oxidizing agent (=redox agent) onto an area of said conductive layer, said area covering only part of the surface of said conductive layer, (c) placing a solution of a precursor of the compound to be deposited in contact both with the redox agent and with at least part of the surface of the conductive layer not covered by the redox agent, said precursor being chosen from those with a redox potential higher or lower than that of the redox agent and forming, after a redox reaction, a compound which is insoluble in the solution of the precursor of the compound to be deposited.

The Applicant has found that during step (c), it was necessary for each of the three agents involved in the redox reaction, namely the redox agent, the conductive layer and the precursor solution of the compound to be deposited, to be in contact with the other two. The reason for this is that this triple contact ensures the electrical neutrality of the solution of the precursor. Thus, the desired reaction (reduction or oxidation of the precursor) does not take place

- when a wire of redox agent is simply dipped into the solution of precursor into which was immersed a substrate with an electrically conductive layer (absence of contact between redox agent and conductive layer), or
- when an isolated drop of the solution of the precursor is deposited on part of the conductive layer not covered by the redox agent (absence of contact between the solution and the redox agent).

As indicated in the introduction, the compound to be deposited is preferably an electrochromic compound. Consequently, the precursor in solution is preferably a compound which, after reduction or oxidation, forms an electrochromic compound that is insoluble in said solution.

Among the known electrochromic compounds, those for which one of the two coloration states is a substantially colorless state are preferred in particular. Examples of such preferred electrochromic compounds that may be mentioned include hexa-cyanometallates such as iron, vanadium, ruthenium, cadmium, chromium, palladium or platinum hexacyano-ferrates, arylviologens and arylalkylviologens, such as benzylviologen, and ($C_7$-$C_{10}$ alkyl)viologens such as heptylviologen.

Despite having advantageous electrochromic behavior, ($C_1$-$C_6$ alkyl)viologens are water-soluble compounds and are consequently unsuitable for the process of the present invention when the solution containing the precursor of the compound to be deposited is an aqueous solution, which is generally the case.

In one particularly preferred embodiment of the process of the invention, the electrochromic compound is iron hexacyanoferrate (Prussian blue) of formula $M^+Fe^{II}Fe^{III}(CN)_6$, in which $M^+$ is a cation, for instance $K^+$ or $\frac{1}{3}Fe^{3+}$, which is yellowish and water-soluble in the completely oxidized state ($Fe^{III}Cl_3$ and $K_3Fe^{III}(CN)_6$) and which forms a layer of blue color, which is insoluble in water when it is in the mixed valence state ($M^+Fe^{II}Fe^{III}(CN)_6$). The latter state is obtained by reducing the precursors present in the solution. The layer formed may itself undergo a reduction to $M'^+M^+Fe^{II}Fe^{II}(CN)_6$, in which M' is a cation, for instance $Li^+$ or $K^+$, and then becomes colorless. Prussian blue is thus electrochromic with a completely colorless clear state $M'^+M^+Fe^{II}Fe^{II}(CN)_6$ and a blue-colored state $M^+Fe^{II}Fe^{III}(CN)_6$.

As indicated in the introduction, the nonconductive substrate onto which is deposited the electrically conductive layer is preferably a transparent or translucent substrate. It may be a mineral glass substrate or a transparent organic substrate, for example made of poly(ethylene terephthalate), polycarbonate, polyamide, polyimide, polysulfones, poly(methyl methacrylate), copolymers of ethylene terephthalate and of carbonate, polyolefins, especially polynorbornenes, diethylene glycol bis(allyl carbonate) homopolymers and copolymers, (meth)acrylic homopolymers and copolymers, especially bisphenol-A based (meth)acrylic homopolymers and copolymers, thio(meth)acrylic homopolymers and copolymers, urethane and thiourethane homopolymers and copolymers, epoxide homopolymers and copolymers, and episulfide homopolymers and copolymers.

The substrate may in particular be a relatively flexible material allowing the deposition of the electrochromic compound by roll-to-roll printing.

When the substrate is formed from a transparent or translucent material, the electrically conductive layer deposited thereon is preferably also formed from a transparent or translucent material. A certain number of organic or mineral transparent conductive materials are known in the art. The most commonly known and most widely used mineral materials are the transparent conductive oxides known under the abbreviation TCO, among which mention may be made of derivatives of tin oxide, of indium oxide and of zinc oxide. Mention may be made in particular of fluorine-doped tin oxide (FTO, fluor tin oxide), tin-doped indium oxide (ITO, indium tin oxide), antimony-doped tin oxide and aluminum-doped zinc oxide. Tin-doped indium oxide (ITO) is particularly preferred.

An advantageous organic electrically conductive transparent material is poly(3,4-ethylenedioxy-thiophene) (PEDOT). This polymer, which is well known for its transparency in the visible range and its intrinsic electron conductivity, has the drawback of being unmeltable and insoluble in the majority of organic solvents, which makes it difficult to use and to apply in the form of thin films. PEDOT is consequently generally sold in the form of an aqueous dispersion of a mixture of poly(3,4-ethylenedioxy-thiophene and of poly(styrene sulfonate) (PSS). In one embodiment of the present invention, the electrically conductive layer is an organic layer containing PEDOT, preferably in combination with PSS.

The transparent electrically conductive layer formed on the transparent substrate preferably has a thickness of between 10 nm and 10 000 nm and in particular between 100 and 300 nm.

After formation of the electrically conductive layer, preferably over all or virtually all of one of the faces of the nonconductive substrate, a redox agent is deposited on a limited area of this conductive layer. This redox agent is, of course, different than the material forming the electrically conductive layer. The latter comment applies in particular to the case of PEDOT, which is, especially in the oxidized state, a transparent conductive polymer, and which, in the reduced state, may act as a reducing agent. In the present invention, PEDOT may consequently act either as a conductive layer or as a reducing agent, but not both at the same time.

The redox agent, deposited in step (b) onto the electrically conductive layer, is preferably a reducing agent for the precursor of the compound to be deposited, in other words a compound with a redox potential below the redox potential of the precursor/compound to be deposited couple.

In one preferred embodiment, the reducing agent is a metal in the metallic state (oxidation state zero) with a redox potential of less than 0.7 V (=redox potential of the $Fe^{III}Fe^{III}(CN)_6/M^+Fe^{II}Fe^{III}(CN)_6$ couple). This metal is preferably chosen from the group formed by Ni, Mo, Cu, Co, In, Fe, Zn, Si, Ag, Ti and Al, in particular from Ni, Ag, Ti and Al, and more preferentially from Ni, Ag and Al.

In another embodiment, the reducing agent is a layer containing poly(3,4-ethylenedioxythiophene) (PEDOT), generally combined with PSS. The advantage of using such a polymeric reducing agent lies in the ease of application. Specifically, the PEDOT/PSS aqueous dispersion may be applied manually with a brush or by printing, whereas the deposition of a metallic layer generally requires more complex techniques such as physical vapor deposition (PVD) and in particular evaporative deposition.

The extent of the area of the surface of the electrically conductive layer covered by the redox agent is relatively small relative to that of the surface of said layer. It preferably represents less than 10%, in particular less than 5% and ideally less than 2% of the extent of the surface of the electrically conductive layer. When the redox agent is nickel, this surface may represent less than 0.5% or even less than 0.2%.

The amount of redox agent to be deposited depends on the thickness of the deposit that it is desired to obtain. Specifically, a metallic or polymeric (PEDOT) reducing agent functions in the present process as a "reservoir" of available electrons, via the conductive layer, for the reduction of the precursor in the oxidized state in solution. The greater this reservoir, the greater the number of reduced precursor molecules that are finally deposited in the form of a solid layer at the surface of the conductive layer.

The Applicant wishes to point out the great economy of the process of the present invention. Specifically, the reduction or oxidation of the compound to be deposited takes place in a very localized manner at the conductive layer-solution interface rather than throughout the solution. Consequently, virtually no formation of deposit is observed on the walls of the container containing the solution, nor any formation of a precipitate in the solution. It is thus possible to prepare a solution containing a large amount of precursor of the compound to be deposited and to use this bath for a large number of samples to be treated. Virtually all of the precursor will undergo a redox reaction at the surface to be treated and will be deposited on this surface. This aspect is particularly important when the compound to be deposited contains noble metals that may then be used virtually without any losses due to possible spurious depositions on the walls of the apparatus.

The concentration of the precursor of the compound to be deposited in the solution is generally between $10^{-3}$ and $10^{-1}$ M.

Step (c) is preferably performed at room temperature, i.e. at a temperature of between 15 and 30° C.

As explained in the introduction, when the conductive layer is a transparent conductive oxide (TCO) or PEDOT, its relatively high square resistance, of the order of 60 ohms/square on a plastic substrate, may prove to be a drawback when the extent of the surface to be covered increases. This problem is quite easy to solve in the context of the present invention via a suitable distribution of the deposit of redox agent. Whereas it is difficult, in the context of an electroplating process, to modify the size and shape of the electrodes used, it is, in contrast, very easy in the non-electrolytic deposition process of the present invention, to deposit the redox agent in the areas and in the amounts that allow the production of a uniform deposit of the electrochromic compound.

In general, when the size of the surface to be treated is relatively small and when there are few risks of formation of a nonuniform deposit, the redox agent is preferably deposited at the edges of the surface of a conductive layer, and in a particularly preferred manner over the entire periphery of the surface of the conductive layer.

For larger surfaces, the deposition of the redox agent in step (b) is preferably performed, in addition, according to a regular pattern extending over the entire surface of the conductive layer but covering only a part thereof. In other words, the deposition of the redox agent has, for example, the form of a regular grid, of a set of equidistant lines, of a set of points uniformly distributed at the surface of the conductive layer. It is not necessary for the various depositions to be in contact with each other, since each of the areas covered with redox agent constitutes an autonomous reservoir of electron donors or acceptors. The deposition of such a regular pattern of redox agent may take place according to known techniques of photolithography comprising (a) the formation of a photocrosslinkable layer, (b) irradiation of the areas to be crosslinked, (c) elimination of the non-irradiated areas (not crosslinked), (d) deposition of the redox agent in the areas not covered by the crosslinked mask, and (e) removal of the crosslinked mask.

Besides photolithography, inkjet deposition, evaporative deposition, screen printing or pad printing may also be used for the deposition of the redox agent.

When the redox agent forms a layer that is consumed by the redox reaction, for instance metallic nickel that is oxidized to $Ni^{2+}$ ions that are soluble in the solution of precursor, the regular pattern applied on the conductive layer is preferably as fine as possible, so as to minimize the esthetic perturbations caused by the uncovered areas after departure of the redox agent.

The duration of the contacting of the solution containing the precursor of the compound to be deposited with the surface of the conductive layer, in step (c), depends on the thickness of the deposit that it is desired to obtain, the nature of the compound to be deposited, the conductivity of the conductive layer, the temperature, the concentration of the solution, etc. The Applicant especially found, quite surprisingly, that the rate of formation of the solid deposit at the surface of the conductive layer depended on the thickness of the nickel deposit. The thicker this deposit, the faster the deposition and the more the contact time could be shortened.

In general, the duration of contacting the conductive film with the solution of precursor is between a few tens of seconds and about ten minutes, for example between 30 seconds and 8 minutes and preferably between 1 minute and 5 minutes.

The contacting of the surface of the conductive layer with the solution may take place in a known manner, for example by immersion, deposition by centrifugation, spraying, application with a roll or coating with a doctor blade. When the substrate is of sufficient flexibility, this contacting advantageously takes place by roll-to-roll printing. As indicated previously, it is necessary for all these techniques to take care to ensure that the redox agent and the conductive layer are both in direct contact with the solution of precursor.

One advantage of the process of the present invention relative to electroplating lies in the fact that, in principle, it is not necessary to immerse the substrate bearing the conductive layer in the solution containing the precursor agent. This advantage is very important when other fragile deposits have been produced beforehand on or under the substrate (for example deposits of mounting adhesives).

In one particularly preferred embodiment of the present invention, the non-electrolytic deposition process comprises the following successive steps:

(a) deposition of a transparent electrically conductive layer onto a transparent nonconductive solid substrate, (b) deposition of a metallic reducing agent onto an area of said transparent conductive layer, said area covering only part of the surface of said conductive layer, and (c) contacting of a solution of an oxidized precursor of a metal hexacyanoferrate both with the reducing agent and with at least part of the surface of the transparent conductive layer, not covered by the reducing agent, for a time sufficient to form a visible solid deposit of hexacyanoferrate at the surface of the transparent conductive layer.

This preferred embodiment is illustrated by means of example 1 below. Example 2 concerns the use of PEDOT as a reducing agent on a layer of ITO.

EXAMPLES

Example 1

A layer of ITO about 200 nm thick is deposited on a transparent poly(diethylene glycol bis(allyl carbonate)) (CR-39 from PPG Industries) substrate of circular shape (diameter 6.7 cm), and metallic nickel is then applied to the edges of the sample thus obtained by evaporative deposition.

The article (CR39-ITO—Ni) is then totally immersed in an aqueous solution containing $10^{-2}$ M of $FeCl_3$ and $10^{-2}$ M of $K_3Fe(CN)_6$. After about 3 minutes, the sample is removed from the solution and it is observed that a uniform blue deposit has formed. The nickel deposit has disappeared, leaving an uncolored area on the edges.

When the same test is repeated, but by dipping the sample in the solution gradually, over a period of 4 minutes, a color gradient is observed.

Example 2

A transparent conductive ITO film about 200 nm thick is deposited on a transparent poly(ethylene terephthalate) (PET) substrate. A PEDOT/PSS (Baytron®PH500 from HC Starck, Clevios®PH500) aqueous dispersion is deposited manually on the periphery of this film, so as to obtain, after drying, a film about 150 mm thick. The article thus obtained is dipped for three minutes in an aqueous solution containing $10^{-2}$ M of $FeCl_3$ and $10^{-2}$ M of $K_3Fe(CN)_6$. After this time, the sample is removed from the solution. A uniform blue color is observed. The PEDOT/PSS film, which, unlike the metallic nickel deposit, persists on the sample, is also blue.

Example 3

The procedure of example 1 is repeated, using, as transparent substrate, PET instead of CR39. After about 3 minutes, the sample is removed from the solution and it is observed that a homogeneous blue deposit has formed.

Example 4

The procedure of example 1 is repeated, using, as redox agent, a deposit of a silver-based adhesive instead of the metallic nickel deposit. After about 3 minutes, the sample is removed from the solution, and it is observed that a uniform blue deposit has formed.

Example 5

A transparent electrically conductive ITO layer about 200 nm thick is deposited on a transparent PET substrate. A layer of aluminum metal is deposited by evaporative deposition on the periphery of this layer. The article thus obtained is dipped for about three minutes in an aqueous solution containing $5\times10^{-3}$ M of heptylviologen dibromide and $10^{-1}$ M of tetrabutyl-ammonium perchlorate. After this time, the sample is removed from the solution. A pink deposit of heptylviologen dimer has formed on the layer of ITO/PET. The deposit of metallic aluminum has dissolved.

The invention claimed is:

1. A process for the non-electrolytic deposition of a compound, comprising the following successive steps:

(a) deposition of an electrically conductive layer onto a nonconductive solid substrate, (b) deposition of a redox agent onto an area of said conductive layer, said area covering only part of the surface of said conductive layer, (c) placing a solution of a precursor of the compound to be deposited in contact with both the redox agent and with at least part of the surface of the conductive layer not covered by the redox agent, said precursor being chosen from those with a redox potential higher or lower than that of the redox agent and forming, after a redox reaction, the compound to be deposited, which compound is insoluble in the solution of the precursor of the compound to be deposited.

2. The non-electrolytic deposition process as claimed in claim 1, wherein the compound to be deposited is an electrochromic compound.

3. The non-electrolytic deposition process as claimed in claim 2, wherein the electrochromic compound is selected from hexacyanometallates, arylviologens, arylalkylviologens and ($C_{7-10}$ alkyl)viologens.

4. The non-electrolytic deposition process as claimed in claim 3, wherein the electrochromic compound is iron hexacyanoferrate (Prussian blue).

5. The non-electrolytic deposition process as claimed in claim 1, wherein the nonconductive substrate and the electrically conductive layer deposited thereon are both formed, each independently, from a transparent or translucent material.

6. The non-electrolytic deposition process as claimed in claim 1, wherein the electrically conductive layer is a layer of tin-doped indium oxide (ITO), a layer of tin-doped fluorine oxide (FTO) or a layer containing poly(3,4-ethylenedioxythiophene) (PEDOT).

7. The non-electrolytic deposition process as claimed in claim 1, wherein the redox agent deposited in step (b) is a reducing agent for the precursor of the compound to be deposited.

8. The non-electrolytic deposition process as claimed in claim 7, wherein the reducing agent is selected from the group consisting of Ni, Mo, Cu, Co, In, Fe, Zn, Si, Ag, Ti and Al, all these metals being in the same metallic state.

9. The non-electric deposition process as claimed in claim 8, wherein the reducing agent is selected from the group consisting of Ni, Ag, Ti, and Al.

10. The non-electrolytic deposition process as claimed in claim 7, wherein the reducing agent is a film containing poly(3,4-ethylenedioxythiophene) (PEDOT).

11. The non-electric deposition process as claimed in claim 7, wherein the reducing agent is selected from the group consisting of Ni, Ag and Al.

12. The non-electrolytic deposition process as claimed in claim 1, wherein the deposition of the redox agent in step (b) is performed at the edges of the surface of the electrically conductive layer.

13. The non-electrolytic deposition process as claimed in claim 1, wherein the deposition of the redox agent in step (b) is performed according to a regular pattern extending over the entire surface of the electrically conductive layer, but covering only a part thereof.

14. The non-electrolytic deposition process as claimed in claim 1, wherein contact time of the solution containing the precursor of the compound to be deposited with the redox agent and with the surface of the conductive layer, in step (c), is between 30 seconds and 8 minutes.

* * * * *